US005160064A

United States Patent [19]

LeBlanc

[11] Patent Number: 5,160,064

[45] Date of Patent: Nov. 3, 1992

[54] FUEL CONTAINMENT COVER ASSEMBLY

[75] Inventor: Leo J. LeBlanc, Bloomfield Hills, Mich.

[73] Assignee: ERW, Inc., Muskegon, Mich.

[21] Appl. No.: 703,503

[22] Filed: May 21, 1991

[51] Int. Cl.[5] ..... B65D 45/00

[52] U.S. Cl. ..... 220/644; 220/327; 220/378; 52/20; 404/25; 137/371

[58] Field of Search ..... 220/315, 327, 378, 465, 220/640, 642, 643, 644, 645; 52/20; 404/25; 141/86; 137/371, 800

[56] References Cited

U.S. PATENT DOCUMENTS

| | | | |
|---|---|---|---|
| 4,188,151 | 2/1980 | Hall . | |
| 4,504,535 | 3/1985 | Snyder | 220/644 X |
| 4,593,714 | 6/1986 | Madden . | |
| 4,662,777 | 5/1987 | Newton . | |
| 4,664,281 | 5/1987 | Falk et al. | 220/327 X |
| 4,762,440 | 8/1988 | Argandona . | |
| 4,763,449 | 8/1988 | Vigneron et al. | 52/20 |
| 4,828,274 | 5/1989 | Stannard | 404/25 X |
| 4,861,186 | 8/1989 | Ferns | 404/25 |
| 4,896,705 | 1/1990 | Podgers . | |
| 4,934,715 | 6/1990 | Johnson | 404/25 X |
| 4,973,191 | 11/1990 | Dannhauser . | |
| 5,050,764 | 9/1991 | Voss | 220/378 |

FOREIGN PATENT DOCUMENTS

| | | | |
|---|---|---|---|
| 0058943 | 5/1979 | Japan | 52/20 |
| 2150619 | 7/1985 | United Kingdom | 52/20 |

*Primary Examiner*—Stephen Marcus
*Assistant Examiner*—Stephen Cronin
*Attorney, Agent, or Firm*—Basile and Hanlon

[57] ABSTRACT

A fuel containment cover assembly comprising a fiberglass skirt with cast iron inserts molded into an integral unit. The inserts are located on the outer perimeter of the skirt and determine the flow of water from the cover to the ground. A pre-molded gasket extends about the interior perimeter of the cover. The gasket seats on the skirt assembly and seals the fuel containment device from the atmosphere. The cover is bolted to the fiberglass skirt and forms a drainage channel between the cover and the skirt.

19 Claims, 2 Drawing Sheets

FUEL CONTAINMENT COVER ASSEMBLY

BACKGROUND OF THE INVENTION

I. Field of the Invention

The present invention relates to fuel containment cover assemblies. More particularly, the present invention relates to a fuel containment cover assembly that is formed of a molded skirt having a sealed cover that combines to create an automatic drainage system.

II. Description of the Relevant Art

Fuel containment devices have been developed for the purpose of protecting the environment against pollution of the ground and/or water by the spillage of gasoline in the vicinity of a fill pipe for an underground storage tank for gasoline, diesel fuel or other toxic chemicals.

The fuel containment device sits in the ground and is sealingly connected with the fill pipe unit extending from the underground storage tank. Such units have generally been designed with the goal of preventing fuel from spilling above the fill pipe into the ground water system. Therefore, the emphasis has been on the development of the seal and the relationship of the spill containment device with the ground.

As a result, these previously known spill containment devices have developed peripheral problems, such as spill containment covers failing under the weight of vehicles traveling over them. Specifically, covers tend to crack and break apart or will lift off from the device itself exposing the container to the atmosphere.

A still further disadvantage of these spill containment devices is that the upper area of the device exposed above the ground level has a tendency to support free standing water or snow, thus creating the possibility of ice developing in the container and possibly cracking or breaking it apart. Further, water that is not systematically drained from the fuel containment device may seep into the fuel stored in the ground.

SUMMARY OF THE INVENTION

The present invention provides a fuel containment cover assembly which overcomes the disadvantages of the previously known fuel containment devices.

The fuel containment cover assembly of the present invention comprises a skirt framing the upper perimeter of the fuel containment device. The skirt is preferably formed of fiberglass material and has a plurality of U-shaped notches about the skirt perimeter.

A plurality of U-shaped inserts having a profile corresponding to the U-shaped notches are seated within the notches of the skirt. These U-shaped inserts are preferably formed of cast iron material.

After the inserts are seated within the notches of the skirt, the assembly is molded together to form a single integrated unit. Molding of a fiberglass skirt with cast iron inserts about its perimeter gives both flexibility and strength to the outer rim of the fuel containment device.

A cover sits on the skirt and is secured to the skirt by mounting means, such as bolts. The cover comprises a gasket seated within a pre-molded groove about the perimeter of the interior of the cover. The gasket is positioned between the cover and the skirt thereby sealing the outer perimeter of the fuel containment device from the atmosphere.

The inserts have a U-shaped profile comprising a base and opposing legs extending outwardly from the base. The base has a height greater than the legs and the legs slope downwardly from the base toward the ground surface area. The sloping legs form a first channel between the legs and a second channel between the legs and the skirt. A third channel is formed between the base and the sealed cover.

After the assembly is placed in the ground and attached to the fuel containment device, concrete is poured about the skirt perimeter to affix the assembly in place. The concrete flows into the first channel between the sloping legs to the height of the base. As a result, water is forced to drain from the third channel formed between the base and the sealed cover down the second channel formed between the sloping legs and the skirt assembly toward the ground. The combination of the concrete and the cast iron inserts creates an automatic draining system.

The cover comprises a plurality of rectangular ridges extending from the top of the cover for safety means. Further, webs extend from the bottom of the cover for reinforcing the strength of the cover. Such reinforcing means strengthens the cover and prevents it from cracking under heavy loads.

Finally, the use of a fiberglass skirt provides elasticity to the perimeter of the fuel containment device, thereby allowing the device to absorb the ground flow created by frost upheaval, ice or rain.

Other advantages and features of the present invention will become more apparent from the following detailed description when read in conjunction with the accompanying drawing.

BRIEF DESCRIPTION OF THE DRAWING

The present invention will be more fully understood by reference to the following detailed description of the preferred embodiments of the present invention when read in conjunction with the accompanying drawing, in which like reference characters refer to like parts throughout the views, and in which.

DETAILED DESCRIPTION OF THE PREFERRED EMBODIMENT

Figure 2:
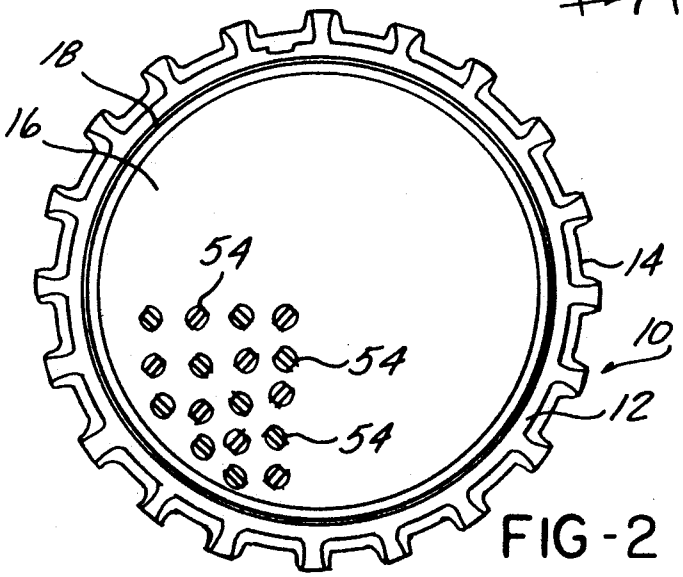
FIG. 2 is a top view illustrating a preferred embodiment of the present invention.

With reference first to FIG. 2, a preferred embodiment the fuel containment cover assembly 10 of the present invention is there shown.

The cover assembly 10 comprises a skirt 12 preferably formed of fiberglass material and having inserts 14 preferably formed of cast iron material. A cover 16 is seated on skirt 12 and seals the cover to the skirt by gasket 18.

Figure 1:
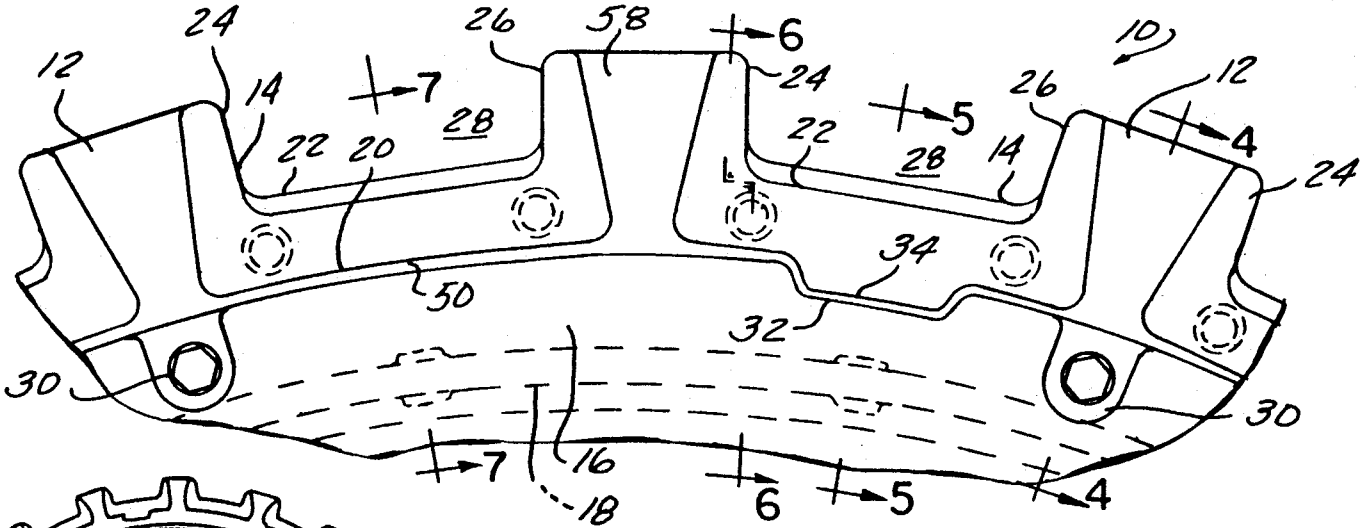
FIG. 1 is a top view illustrating a cut-away section of the preferred embodiment of the present invention.

With reference now to FIG. 1, a partial view of the cover assembly 10 is there shown and enlarged for clarity. Skirt 12 frames the upper perimeter of a fuel containment device and comprises a plurality of U-shaped notches 20 about its perimeter. Inserts 14, having a profile corresponding to the U-shaped notches 20, are seated within the notches 20 of the skirt 12. Inserts 14 comprise a base 22 and opposing legs 24, 26 extending outwardly from the base 22. The base 22 has a height greater than the legs 24, 26 as best seen in FIGS. 4 through 7. The legs 24, 26 slope downwardly from the base 22 to form a channel 28 in the area between the legs 24, 26.

Cover 16 is seated within the skirt 12 and is mounted on the skirt by mounting means such as bolts 30. Cover 16 comprises a notched area 32 corresponding to an extrusion 34 in insert 14. Notch 32 and corresponding extrusion 34 ensure the proper placement of the cover 16 on the skirt 12.

Figure 4:
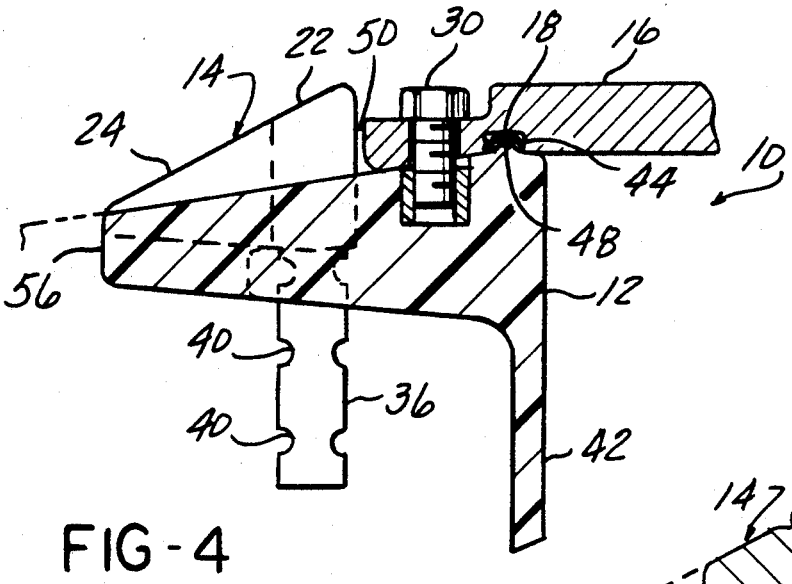
FIG. 4 is a cross sectional view taken along line 4—4 in FIG. 1 and enlarged for clarity.

With reference now to FIG. 4, an enlarged area of assembly 10 is there shown. Leg 24 of insert 14 is shown sloping downwardly from the base 22 toward the skirt 12. Insert 14 comprises two fingers 36, 38 having circumferential grooves 40 extending about its perimeter for securing the assembly 10 in the ground.

Skirt 12 also comprises a circumferential, hollow neck 42 locating the unit 10 within the fuel containment device.

Figure 5:
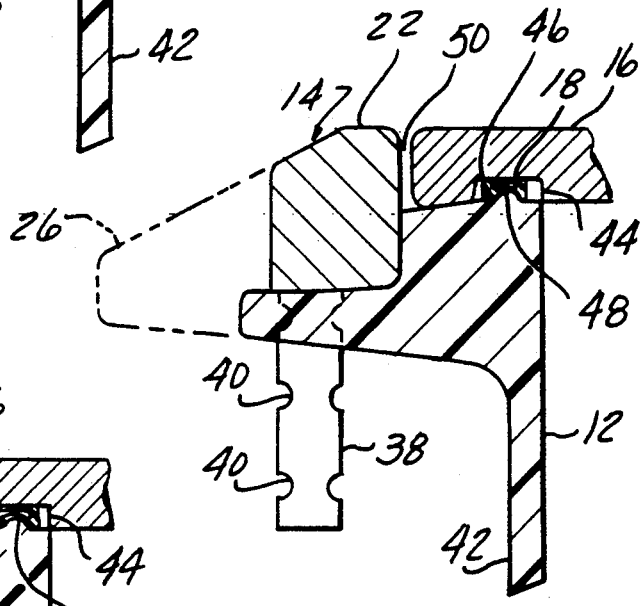
FIG. 5 is a cross sectional view taken along line 5—5 in FIG. 1 and enlarged for clarity.
Figure 6:
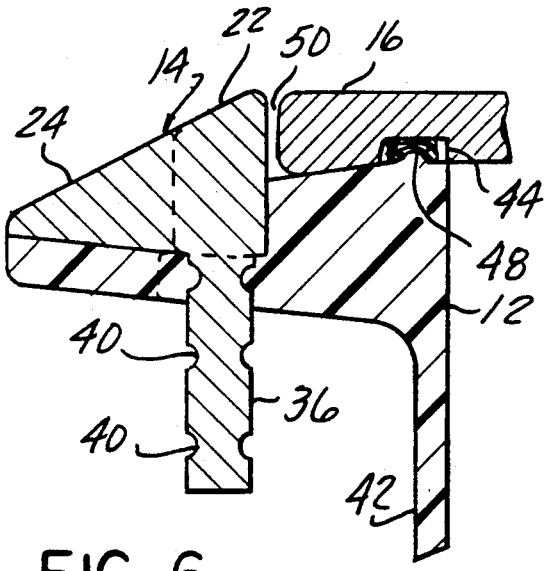
FIG. 6 is a cross sectional view taken along line 6—6 in FIG. 1 and enlarged for clarity.
Figure 7:
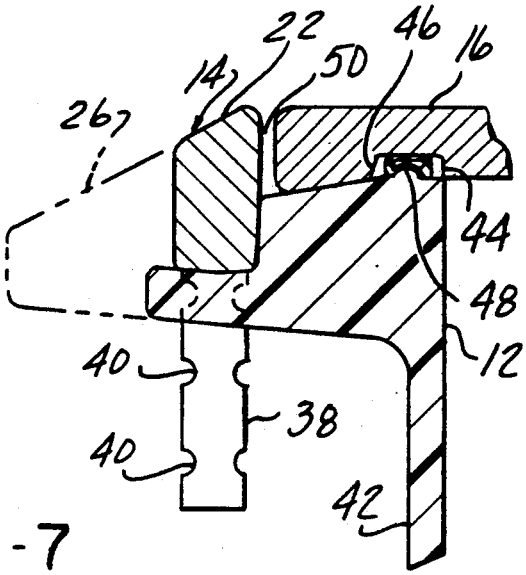
FIG. 7 is a cross sectional view taken along line 7—7 in FIG. 1 and enlarged for clarity.

With reference now to FIGS. 5 and 7, gasket 18 is there shown seated within a pre-molded groove 44 extending about the perimeter of the interior of the skirt 12. FIGS. 5 and 7 show the enlarged area 46 which is provided along the groove 44 for placement of the gasket 18 within the groove 44.

FIGS. 4 through 7 also show shoulder 48 extending above the skirt 12 for seating gasket 18. Shoulder 48 extends into groove 44 thereby compressing gasket 18 and creating a seal about the perimeter of the cover 16. Channel 50 is created by the sealing engagement of the cover 16 on the skirt 12 and the extension of the base 22 above the skirt 12.

Figure 3:
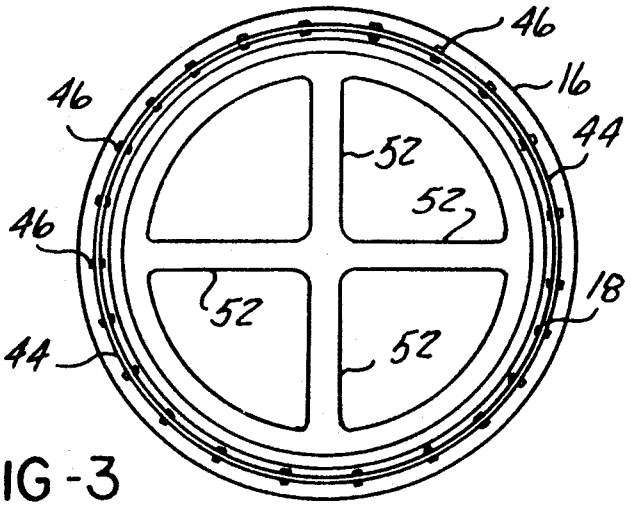
FIG. 3 is a bottom view of FIG. 2.

With reference now to FIG. 3, a bottom view of the cover 16 is there shown. Gasket 18 is seated within groove 44 pre-molded with the cover 16. Enlarged areas 46 are also premolded in the cover 16 to aid in seating the gasket 18 within groove 44. Webs 52 are also pre-molded into the cover 16 and aid in reinforcing the strength of the cover 16.

With reference now to FIG. 2, the top of the cover 16 is there shown and comprises a plurality of rectangular ridges 54 extending from the top of the cover 16 for safety means or purposes.

The assembly 10 is formed by first molding the inserts 14 out of cast iron. The inserts 14 are then set into a fiberglass skirt mold in a pattern as shown in FIG. 2. The inserts 14 are then molded into a single integrated unit with the circular fiberglass skirt. This assembly is then set into the ground and concrete is poured around it.

When the concrete is poured, it flows into channel 28 and fills in up to the base of the skirt area 56, as shown in FIG. 4. The combination of the concrete and inserts creates a channeled flow of water through second channel 50 downward along extruded tongue area or conduit 58 toward the ground (FIG. 1). The sealed cover 16 prevents the water from flowing upward into the fuel containment device. Thus, a drainage system is automatically provided simply by proper assembly of the unit itself.

A multiplicity of inserts and tongue extrusions are provided to compensate for improper flow due to a change in the ground slope after settlement of the concrete. Further, frost upheaval will not defeat the system as the fiberglass skirt has elasticity to overcome any changes in the ground level.

A still further advantage of the assembly is the pre-molded groove within the cover to accommodate a gasket for sealing. Further, the pre-molded webs formed in the bottom of the cover reinforce the strength of the cover. As the cover is mounted to the fiberglass skirt, an extreme load on the cover will not break the seal as the webs act in combination with the bolts seated in the elastic fiberglass to strengthen the seal support.

Having described the invention, however, many modifications thereto will become apparent to those skilled the art to which it pertains without deviation from the spirit of the invention as defined by the scope of the appended claims.

What is claimed is:

1. A cover assembly for an upper perimeter of a fuel containment device, said cover assembly comprising:

a skirt having a plurality of notches spaced about an outer perimeter; and a plurality of inserts having profiles corresponding to said notches for seating within said notches, wherein said skirt and said inserts are molded into a single integrated unit.

2. The cover assembly of claim 1, wherein said skirt further comprises a circumferential hollow neck extending downwardly from said skirt for locating said skirt contiguous with the fuel containment device.

3. The cover assembly of claim 2 wherein said skirt is formed of fiberglass material and said inserts are formed of cast iron material.

4. The cover assembly of claim 3, wherein each of said inserts has a U-shaped profile defined by a base and opposing legs extending outwardly from said base, said base having a height greater than said legs, said legs sloping downward from said base and forming a first channel in between said legs and forming a conduit between adjacent inserts and said skirt; and a plurality of circumferentially grooved fingers extending downwardly from each of said inserts for securing said skirt in concrete.

5. The cover assembly of claim 4 further comprising:

a circumferential cover capable of being seated on said skirt;

mounting means for securing said cover to said skirt; and means for sealing said cover with respect to said skirt.

6. The cover assembly of claim 5 further comprising means for aligning said cover on said skirt in a predisposed position.

7. The cover assembly of claim 6 further comprising:

a plurality of rectangular ridges extending from the top of said cover for safety purposes; and webs extending from the bottom of said cover for reinforcing the strength of said cover.

8. The cover assembly of claim 5, wherein said mounting means comprises a bolt extending through said cover and seating in said skirt.

9. The cover assembly of claim 5 further comprising:

a second channel formed between said skirt and said cover for draining fluid from said cover through said conduit.

10. A cover assembly for an upper perimeter of a fuel containment device, said assembly comprising:

a circumferential fiberglass skirt including a plurality of cast iron inserts molded into said skirt to form a single integral unit;

a cover capable of being seated on said unit; and means for sealing said cover with respect to said unit, said sealing means including a gasket and a groove extending adjacent an interior perimeter of said cover for mounting said gasket.

11. The cover assembly of claim 10, wherein said skirt further comprises:

a circumferential hollow neck extending downwardly from said skirt for locating said unit contiguous with the fuel containment device;

wherein said skirt frames the upper perimeter of the fuel containment device.

12. The cover assembly of claim 10, wherein each of said inserts has a U-shaped profile defined by a base and opposing legs extending outwardly from said base, said base having a height greater than said legs, said legs sloping downward from said base and forming a first channel between said legs and a conduit between adjacent inserts and said skirt; and a plurality of circumferentially grooved fingers extending downwardly from each of said inserts for securing said unit in concrete.

13. The cover assembly of claim 10 further comprising:

means for aligning said cover on said skirt in a predisposed position; and means for mounting said cover on said skirt.

14. The cover assembly of claim 13 further comprising:

a plurality of rectangular ridges extending from the top of said cover for safety purposes; and webs extending from the bottom of said cover for reinforcing the strength of said cover.

15. The cover assembly of claim 13, wherein said mounting means comprises a bolt extending through said cover and seating in said skirt.

16. The cover assembly of claim 15 further comprising:

a second channel formed between said skirt and said cover for draining fluid from said cover through said conduit.

17. A cover assembly for an upper perimeter of a fuel containment device, said cover assembly comprising:

a circumferential fiberglass skirt including a plurality of cast iron inserts molded into said skirt to form a single integral unit, said skirt including a circumferential hollow neck extending downwardly from said skirt for locating said unit contiguous with the fuel containment device, wherein each of said inserts has a U-shaped profile defined by a base and opposing legs extending outwardly from said base, said base having a height greater than said legs, said legs sloping downward from said base and forming a first channel between said legs and a conduit between adjacent inserts and said skirt, and a plurality of circumferentially grooved fingers extending downwardly from each of said inserts for securing said unit in concrete;

a cover capable of being seated on said skirt;

means for aligning said cover on said skirt in a predisposed position;

means for mounting said cover on said skirt; and means for sealing said cover with respect to said skirt including a gasket and a groove extending adjacent an interior perimeter of said cover for mounting said gasket.

18. The cover assembly of claim 17 further comprising:

a plurality of rectangular ridges extending from the top of said cover for safety purposes; and webs extending from the bottom of said cover for reinforcing the strength of said cover.

19. The cover assembly of claim 17, wherein said mounting means comprises a bolt extending through said cover and seating in said skirt.

* * * * *

UNITED STATES PATENT AND TRADEMARK OFFICE

CERTIFICATE OF CORRECTION

PATENT NO. : 5,160,064

DATED : November 3, 1992

INVENTOR(S) : Leo J. LeBlanc

It is certified that error appears in the above-identified patent and that said Letters Patent is hereby corrected as shown below:

Title page: Item[73], in the designation of the Assignee, please delete "ERW" and insert --EBW--.

Column 2, line 30, after "accompanying", please delete --.--.

Column 2, line 57, before "the fuel", please insert --of--.

Signed and Sealed this

Fifth Day of October, 1993

Bruce Lehman

*Attest:*

BRUCE LEHMAN

*Attesting Officer*

*Commissioner of Patents and Trademarks*